US008614540B2

(12) United States Patent
Braeuchle et al.

(10) Patent No.: US 8,614,540 B2
(45) Date of Patent: Dec. 24, 2013

(54) HF IGNITION DEVICE

(75) Inventors: Gerd Braeuchle, Hueffenhardt (DE); Felizitas Heilmann, Gerlingen (DE); Tom Achtstaetter, Hemmingen (DE); Thomas Giffels, Stuttgart (DE); Christian Mayer, Untergruppenbach (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 288 days.

(21) Appl. No.: 13/086,599

(22) Filed: Apr. 14, 2011

(65) Prior Publication Data

US 2011/0253089 A1 Oct. 20, 2011

(30) Foreign Application Priority Data

Apr. 17, 2010 (DE) ..... 10 2010 015 343

(51) Int. Cl.
*H01T 13/20* (2006.01)

(52) U.S. Cl.
USPC ..... 313/141; 313/130; 313/124; 123/608

(58) Field of Classification Search
USPC ..... 123/143, 169 E, 169 EL, 169 MG, 606, 123/608; 313/124, 130, 131 R, 136, 141, 313/143–145
See application file for complete search history.

(56) References Cited

U.S. PATENT DOCUMENTS

| | | | | |
|---|---|---|---|---|
| 4,841,925 | A * | 6/1989 | Ward | 123/143 B |
| 4,944,259 | A | 7/1990 | Richardson | |
| 6,329,743 | B1 * | 12/2001 | Camilli | 313/141 |
| 6,583,537 | B1 | 6/2003 | Honda et al. | |
| 6,822,378 | B2 * | 11/2004 | Nishikawa et al. | 313/143 |
| 6,883,507 | B2 * | 4/2005 | Freen | 123/606 |
| 7,388,323 | B2 * | 6/2008 | Shibata et al. | 313/143 |
| 2004/0123851 | A1 * | 7/2004 | Schmidt et al. | 123/606 |
| 2004/0129241 | A1 | 7/2004 | Freen | |
| 2006/0220510 | A1 * | 10/2006 | Shibata | 313/141 |
| 2007/0114901 | A1 * | 5/2007 | Nagasawa et al. | 313/141 |
| 2008/0018216 | A1 * | 1/2008 | Camilli | 313/141 |
| 2008/0121200 | A1 * | 5/2008 | Kato et al. | 123/143 B |
| 2008/0132810 | A1 * | 6/2008 | Scoseria et al. | 601/4 |
| 2008/0141967 | A1 * | 6/2008 | Tani et al. | 123/143 B |
| 2009/0153009 | A1 * | 6/2009 | Maurer et al. | 313/141 |
| 2011/0139107 | A1 * | 6/2011 | Burrows et al. | 123/169 EL |

FOREIGN PATENT DOCUMENTS

| | | | | | |
|---|---|---|---|---|---|
| DE | 197 23 784 | C1 | | 8/1998 | |
| DE | 197 45 | A1 | | 4/1999 | |
| DE | 101 28 397 | A1 | | 12/2002 | |
| EP | 1 515 594 | A2 | | 9/2004 | |
| JP | 57186067 | A | * | 11/1982 | F02P 23/04 |
| JP | 57203870 | A | * | 12/1982 | F02P 15/10 |
| WO | WO 2010/011838 | A1 | | 1/2010 | |
| WO | WO 2010081153 | A2 | * | 7/2010 | H01T 13/52 |

* cited by examiner

*Primary Examiner* — Stephen K Cronin
*Assistant Examiner* — Joseph Dallo
(74) *Attorney, Agent, or Firm* — Hackler Daghighian & Martino

(57) ABSTRACT

The invention relates to an HF ignition device for igniting a fuel in an internal combustion engine with a corona discharge, comprising an ignition electrode, an insulating body on which the ignition electrode is mounted, the insulating body having a continuous channel in which an inner conductor leading to the ignition electrode is disposed, and an outer conductor which encloses the insulating body and, in combination with a section of the inner conductor, forms a capacitor, wherein the channel is filled with an electrically conductive filling material which encloses at least one conductor piece that forms at least one section of the inner conductor.

12 Claims, 5 Drawing Sheets

HF IGNITION DEVICE

The invention relates to a high-frequency ignition device for igniting fuel with a corona discharge. A HF ignition device of this type is known from EP 1 515 594 A2.

To ignite a combustible gas mixture in an engine, the ignition electrode of such an HF ignition device is excited using a suitable circuit, e.g. an HF oscillating circuit. A high-frequency high voltage is produced as a result, creating a plasma in the combustion chamber of the engine and thereby inducing ignition. Details of igniting combustible gas mixtures in a engine by means of a corona discharge are described in WO 2010/011838 A1 and WO 2004/063560 A1 which are incorporated into the present application by reference.

One part of the circuit used to generate the high-frequency alternating voltage is a capacitor, the dielectric of which is formed by the insulator body which encloses the inner conductor leading to the ignition electrode.

HF ignition devices are an alternative to conventional spark plugs which induce ignition using an arc discharge and are subject to considerable wear due to electrode erosion. HF ignition devices have the potential to achieve a longer service life, although this has not happened yet. The reason is that, at frequencies of typically at least one MHz and voltages of a few kV, e.g. 50 kV to 500 kV, the dielectric strength during operation has proven to be problematic. Voltage overloads and partial discharges often cause an HF ignition device to fail prematurely.

The problem addressed by the present invention is therefore that of demonstrating a way to improve the service life of an HF ignition device.

SUMMARY OF THE INVENTION

Surprisingly, the dielectric strength can be markedly improved by placing an electrically conductive filling material in the channel of the insulating body, which wets the channel along the entire length that is enclosed by the outer conductor. The inner surface of the insulating body is therefore wetted by the filling material at least on the longitudinal section of the insulating body enclosed by the outer conductor. The channel can also be wetted with filling material in sections of the insulating body that extend out of the outer conductor, but this is not necessary.

The inner walls of the channel, which is typically designed as a bore, can be completely wetted with the filling material. The filling material, in combination with a conductor that encloses the insulating body, then forms a capacitor having a highly uniform electric field. Local field peaks, which might result in breakdowns or partial discharges, can be largely prevented according to the invention. Seamless wetting of the inner side of the insulating body with the electrically conductive filling material therefore results in increased dielectric strength of the HF ignition device.

The electrically conductive filling material can be a ceramic putty or a conductive adhesive, for example. A molten metal can also be used as the filling material, in particular soft solder or preferably glass which has been made to be electrically conductive by way of conductive additives, such as metallic particles or carbon particles. The filling material can be poured, e.g. as paste or fluid, into the channel. However, a fluid, electrically conductive filling material can also be poured into the channel by filling same with a powder which is subsequently melted. Gas or metal, in particular, can be poured into the channel in this manner in the form of powder. Before the filling material is hardened, e.g. by cooling a paste or fluid, or curing same by way of a chemical reaction, a conductor which forms at least a section of the inner conductor can be pressed into the channel.

The hardening step can be preceded by the melting of the filling material poured in as powder, and therefore the fluid created by way of melting subsequently hardens by cooling.

The conductor can be pressed into the channel from the end next to the combustion chamber, i.e. the end of the HF ignition device comprising the ignition electrode, or from the opposite end. The conductor which is pressed into the channel is preferably a pin. Basically, however, the pressed-in conductor can be very short and have a length in particular that is less than the thickness thereof.

In the case of an ignition device according to the invention, an electrically conductive filling material is poured into the channel and surrounds at least one metallic conductor piece, preferably at least one pin. The filling material wets the inner side of the insulating body at least where the insulating body is enclosed by the outer conductor and can therefore prevent voltage spikes which reduce the breakdown strength of the capacitor formed by the insulating body. An HF ignition device according to the invention therefore has a longer service life.

The filling material can enclose the conductor piece along the entire length thereof, or at one portion of the length thereof. The conductor piece can be a pin which is so long that it extends through the insulating body. It is also possible, however, for the conductor piece to be shorter than the channel and form only a subsection of the inner conductor. A further subsection can be formed by the filling material and/or a conductor piece inserted into the channel at the opposite end.

According to an advantageous refinement of the invention, an end section of the channel extending out of the outer conductor contains an air-filled annular space. Such an annular space advantageously makes it possible to compensate for tolerances in filling amount. The section of the insulating body which is enclosed by a conductor and therefore forms the dielectric of the capacitor is of primary importance for the breakdown strength of the capacitor formed in combination with the insulating body. An unwetted end section of the channel may at most diminish the breakdown strength to an insignificant extent, although it greatly simplifies the filling of the electrical filling material, since greater tolerances can be permitted in terms of apportioning the filling amount. The air-filled annular space is preferably not enclosed by the outer conductor, and is therefore disposed in entirety in a section of the insulating body extending out of the outer conductor. The annular space can be provided on the combustion chamber-side end of the insulating body or on the end of the insulating body opposite the combustion chamber. Preferably, the air-filled annular space is enclosed at the end of the insulating body opposite the combustion chamber by a shield cap which shields it against electromagnetic fields.

The distance between the conductor piece and the enclosing channel inner wall in the air-filled annular space is preferably greater than in a filled channel section in which the conductor is enclosed by filling material. Particularly preferably, the air-filled annular space is disposed in a widened channel section. An increased distance can also be attained, however, by designing a section of the conductor to be thinner.

According to a further advantageous development of the invention, the filling material wets an electrically conductive closure of the channel. The closure can be a disk, for example, which lies on the insulating body and covers the channel. The closure is preferably a section of the conductor piece extending into the channel. Advantageously, the conductor piece can form the closure by way of a section that comprises a mating surface that forms an angle with the longitudinal direction of the channel. The mating surface can be conical in shape, for example. In conformance therewith, the channel can taper at one point, and the insulating body can thereby have a corresponding mating surface. The surface by way of which the section of the conductor piece closing the channel rests on the insulating body can also extend perpendicularly to the longitudinal direction of the channel, however, e.g. in that the conductor comprises a section that widens in a stepped manner and bears on a shoulder or end surface of the insulating body.

An electrically conductive closure allows the production of an HF ignition device according to the invention to be simplified in that, first, the channel at one end is closed with a plate or a conductor inserted into the channel, the filling material is subsequently poured into the channel, and a conductor piece is then pressed into the filling material at the other end of the channel. If a conductor piece is inserted into only one end of the channel, it can be pressed in after the filling material is added, or the conductor piece can be inserted into the channel first and then an annular space enclosing the conductor piece can be filled with filling material. By proving the closure as a section of a conductor piece extending into the channel, a connection of the filling material with the electrically conductive closure is attained that is particularly advantageous in terms of electrical and mechanical aspects. Preferably, a conductor piece comprising the closure is inserted into the channel, filling material is added, and a second conductor piece is subsequently inserted into the channel at the other end.

The ignition electrode of an HF ignition device according to the invention can be designed as an ignition tip on one end of a conductor extending out of the channel. The ignition electrode is preferably designed as a plate, however. Such an ignition electrode covers a larger area, preferably a portion of the end face of the insulating body. The ignition electrode can be used in particular to close the channel.

Preferably, the inner conductor section which, in combination with the outer conductor, forms the capacitor is composed of an electrically conductive filling material by at least one-fifth and preferably by at least one-fourth of the diameter thereof. The inner conductor can be composed in entirety of filling material along a portion of the length thereof. A conductor piece extending into the channel can also form a portion of the inner conductor, but should not be too thick, in order to ensure that the filling material can easily fill a remaining annular space between the conductor piece and the insulating body. Preferably the filling material should have a thickness of at least one millimeter, preferably at least two millimeters, in the inner conductor section which forms the capacitor in combination with the outer conductor.

The outer conductor is preferably designed as a metal sleeve, although it may also be designed as an electrically conductive coating of the insulating body, for example. Preferably the insulating body has an electrically conductive coating which is composed of metal or an electrically conductive ceramic, for example, and is additionally enclosed by a metal sleeve.

BRIEF DESCRIPTION OF THE DRAWING

Further details and advantages of the invention are explained using embodiments, with reference to the attached drawings. Components that are identical and similar are labelled using the same reference numerals. In the drawings.

DETAILED DESCRIPTION

Figure 1:
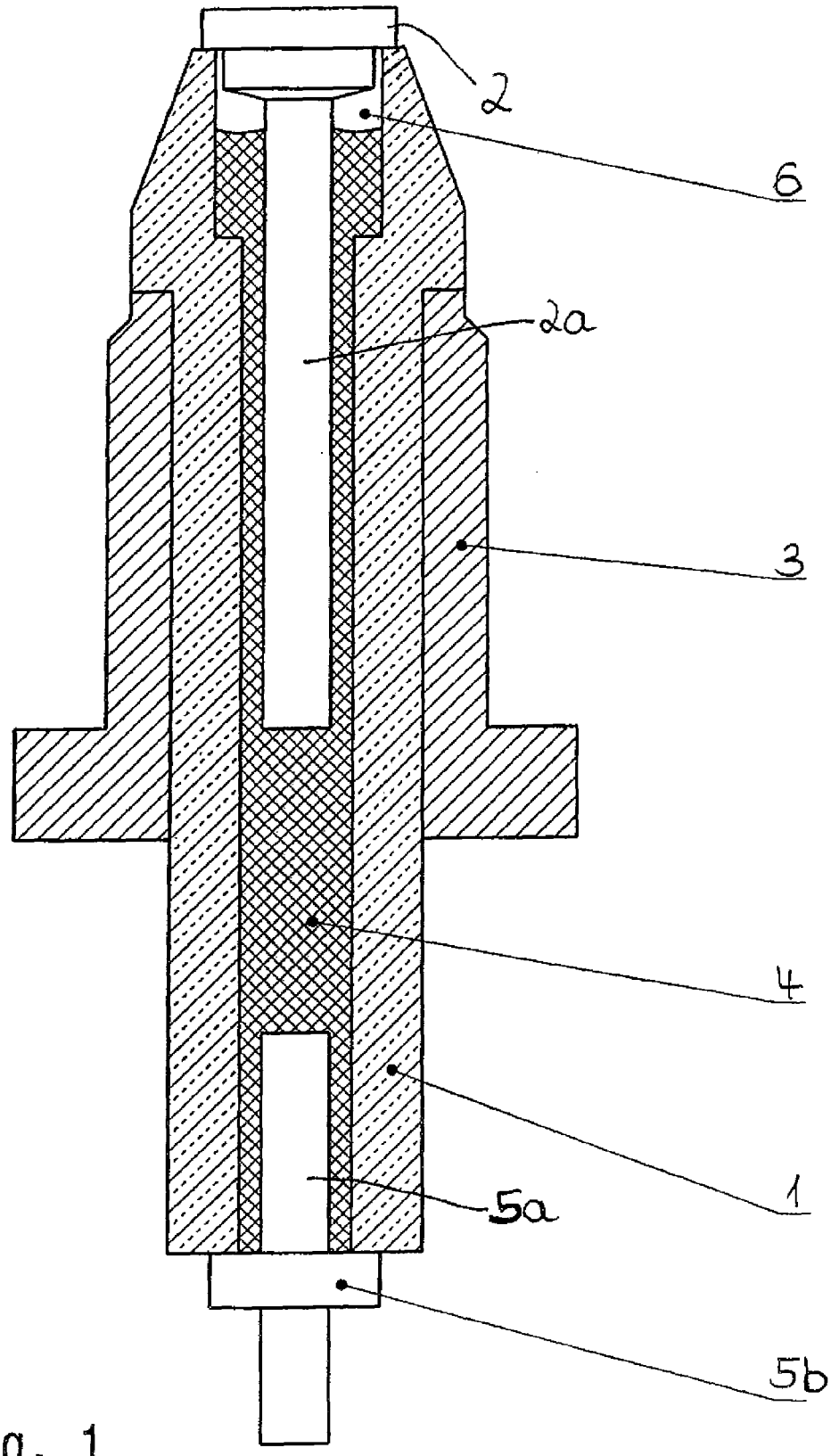
FIG. 1 shows a longitudinal view of an embodiment of an HF ignition device according to the invention.

The HF ignition device depicted schematically in FIG. 1 comprises an insulating body 1 which has an ignition electrode 2 on one end and is enclosed by an outer conductor 3 along a portion of the length thereof. A channel, preferably a bore, extends in insulating body 1 and contains an inner conductor which, in the embodiment shown, is formed by an electrically conductive filling material 4 and conductor pieces 2*a*, 5*a* inserted into the two ends of the channel.

Outer conductor 3, in combination with the inner conductor, forms a capacitor, the dielectric of which is insulating body 1. This capacitor is part of a circuit which is not depicted and is used to generate high-frequency alternating voltage. Further elements of said circuit can be disposed in a housing which is not depicted and extends out of the HF ignition device shown in FIG. 1.

To produce the HF ignition device shown, the channel is closed at one end using an electrically conductive, preferably metallic closure 5*b*. In the embodiment shown, the closure is designed as a widened cover section of conductor piece 5*a* inserted into insulating body 1. Although extension into the channel is advantageous since it results in better adhesion, it is not necessary. Closure 5*b* can therefore also be designed as a disk, for example.

Electrically conductive filling material 4 is subsequently poured into the channel. Filling material 4 can be added as a paste or fluid, e.g. as a conductive adhesive, compound or putty. It is also possible to add filling material 4 in the form of a powder, e.g. metal powder or a mixture of glass and carbon particles or metal particles, and to subsequently melt it.

As soon as fluid filling material 4 is located in the channel, conductor 2*a* comprising ignition electrode 2 on the end thereof is pressed into the channel. Conductor 2*a*, as well as conductor piece 5*a*, are then enclosed in the channel by filling material 4 which wets the inner side of the channel and closure 5*b*. The inner conductor is formed by filling material 4 between conductor pieces 2*a* and 5*a*.

Pressing conductor piece 2*a* inward causes fluid filling material 4 to become displaced and enter the end section of the channel which is preferably widened. The end section of the channel contains an air-filled annular space 6. The size of air-filled annular space 6 differs depending on the amount of filling material 4 that was added. The end section of the channel thus serves as volume control for filling amount tolerances.

In the example shown, ignition electrode 2 covers one end of the channel. Ignition electrode 2 can be designed as a plate, for example, installed on conductor piece 2*a*. As an alternative, ignition electrode 2 can also be designed as an ignition tip, for example.

Figure 2:
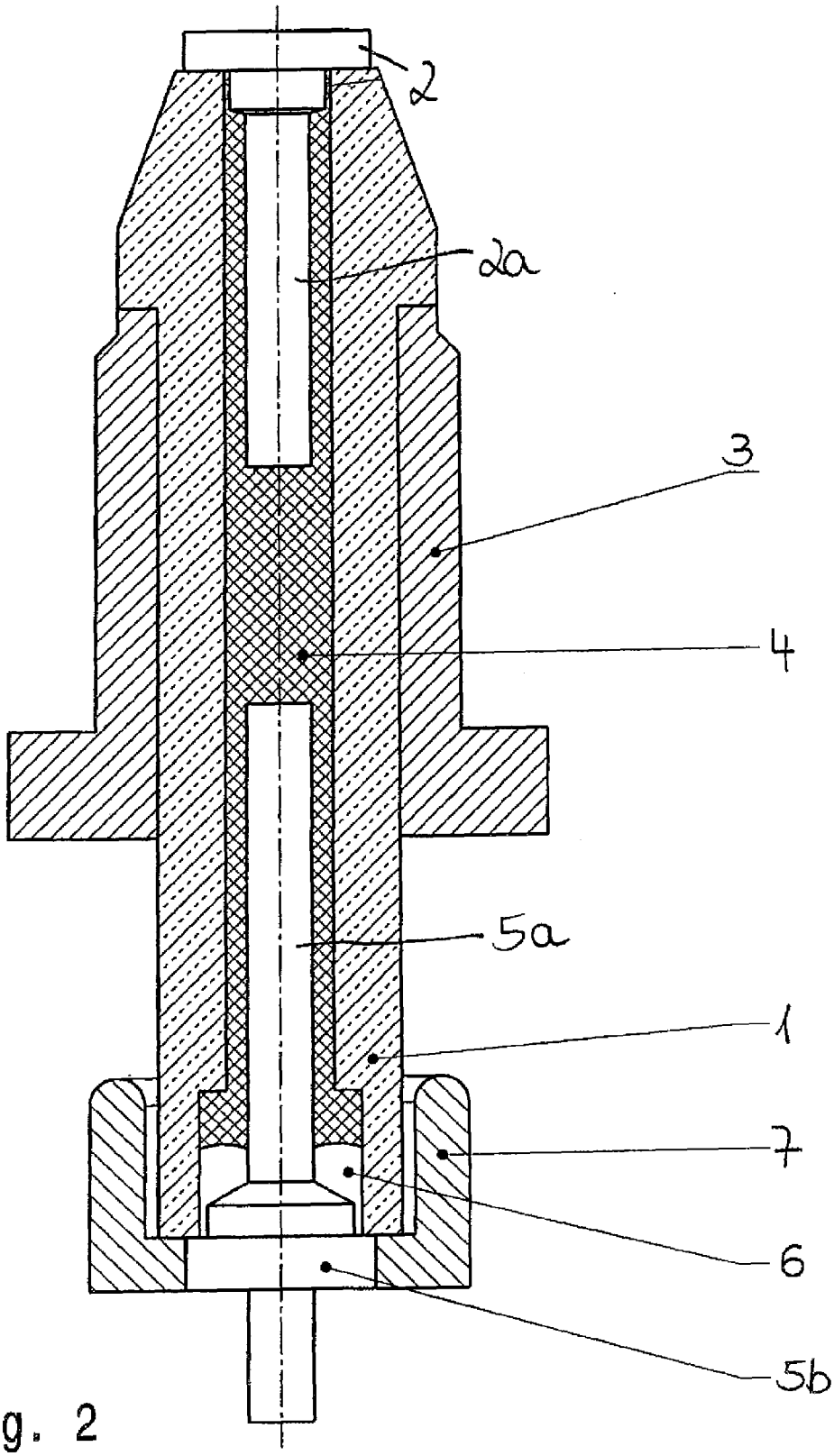
FIG. 2 shows a longitudinal view of a further embodiment.

FIG. 2 shows a further embodiment which differs from the above-described embodiment mainly only in that air-filled annular space 6 is disposed on the end of the channel facing away from ignition electrode 2, i.e. the end opposite the combustion chamber. By contrast, in the embodiment shown in FIG. 1, air-filled annular space 6 is disposed on the opposite end of the channel, i.e. at ignition electrode 2.

In the embodiment shown in FIG. 2, a shield cap 7 is disposed on the end of insulating body 1 opposite the combustion chamber. Shield cap 7 provides an electromagnetic shield for air-filled annular space 6.

Figure 3:
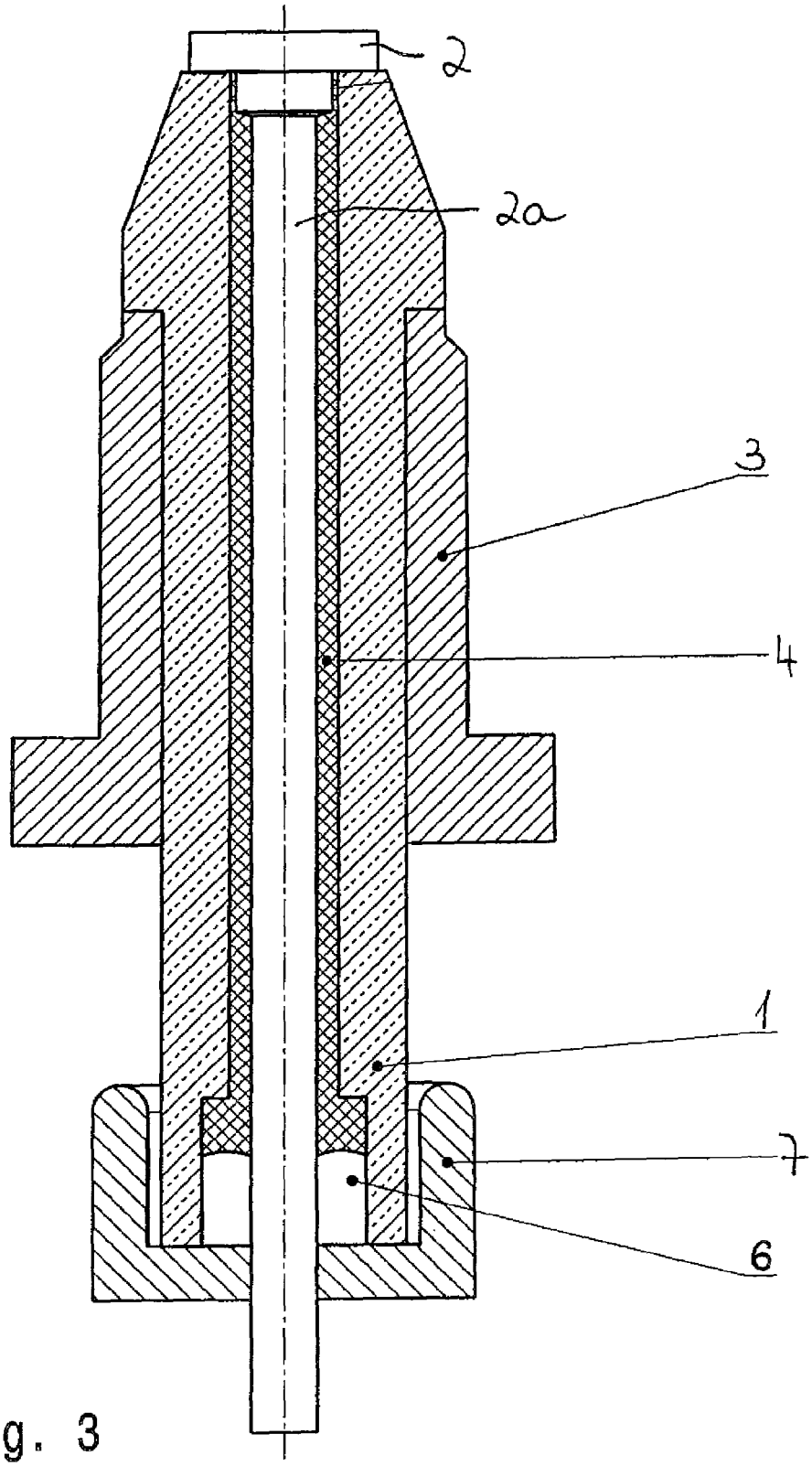
FIG. 3 shows a longitudinal view of a further embodiment.

A further embodiment of an HF ignition device is shown in FIG. 3. In this embodiment, only one conductor 2*a* is inserted into the channel of insulating body 1. Conductor piece 2*a* is a pin which is longer than the channel. In the embodiment shown, conductor piece 2*a* inserted into the channel extends outwardly from a plate-type ignition electrode 2. It is also basically possible, however, to insert a correspondingly long conductor piece 2*a* into the end of insulating body 1 opposite the combustion chamber, and so conductor piece 2*a* extends out of insulating body 1 at the end near the combustion chamber. The end extending outwardly can then form ignition electrode 2.

If only one conductor piece 2*a* is inserted into the channel of insulating body 1, then the HF ignition device can be manufactured such that, first, conductor piece 2*a* is inserted into insulating body 1, wherein a closure—ignition electrode 2 in the embodiment shown—placed into conductor piece 2*a* closes one end of the channel. Next, fluid filling material 4 is poured into the channel, and so an annular space 6 enclosing conductor piece 2*a* is filled with electrically conductive filling material 4. It is also possible, however, to first fill the channel with a fluid but viscous filling material, e.g. an electrically conductive compound or putty, and to then press conductor 2*a* into the channel.

Figure 4:
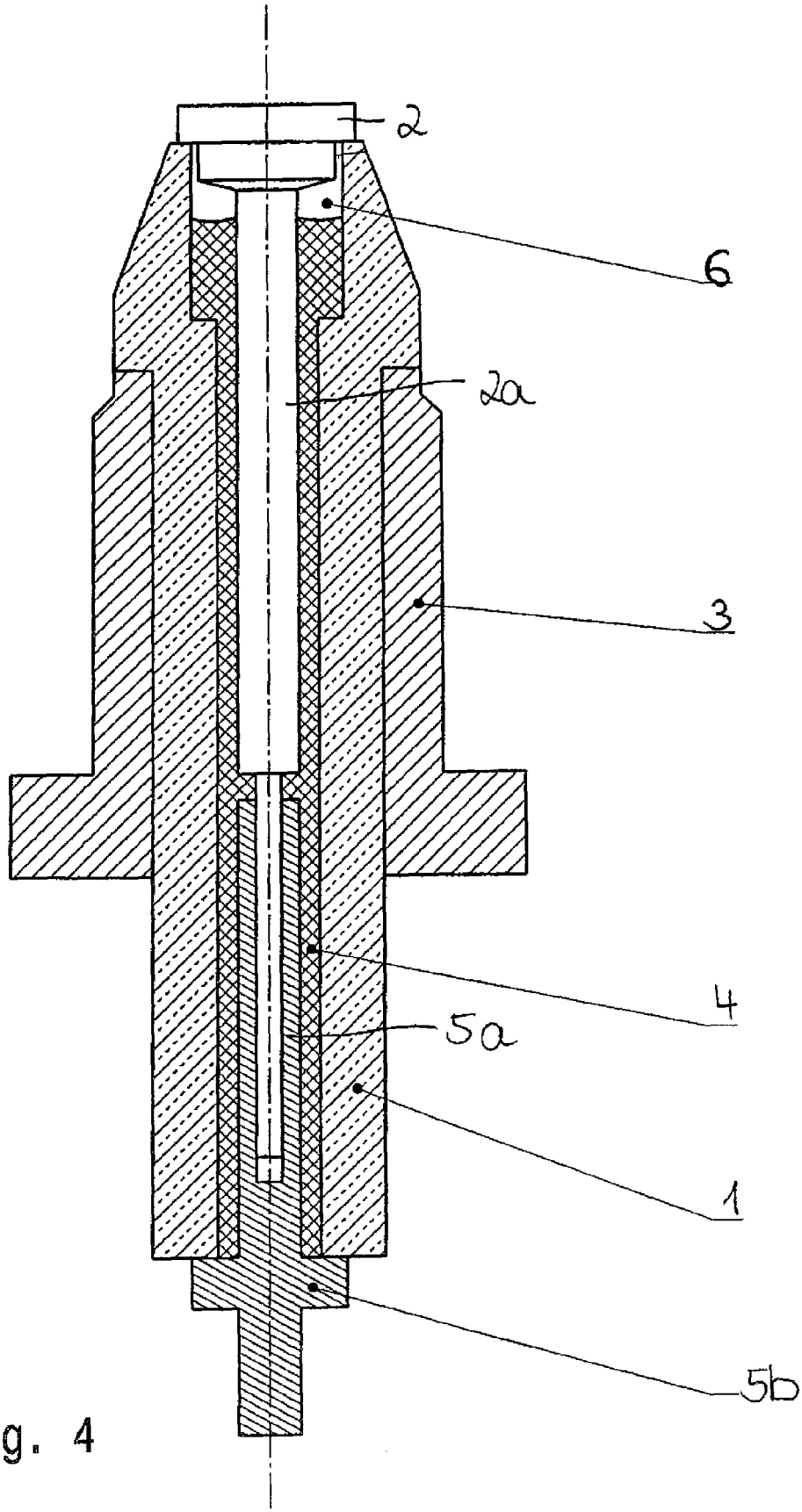
FIG. 4 shows a longitudinal view of a further embodiment.

FIG. 4 shows a further embodiment which largely corresponds to the embodiment depicted in FIG. 1. The main difference is that the two conductor pieces 2*a*, 5*a* inserted into channel of insulating body 1 at different ends touch each other. To improve the electrical and mechanical contact between the two conductor pieces 2*a*, 5*a*, they can be inserted into each other, as shown in FIG. 4. For this purpose, one of the two conductor pieces 2*a*, 5*a* can comprise a slot into which a narrower section of the other conductor engages, as in the case of a groove and spring connection, for example. It is also possible for one of the two conductor pieces to comprise a hole into which a narrow section of the other conductor engages.

Figure 5:
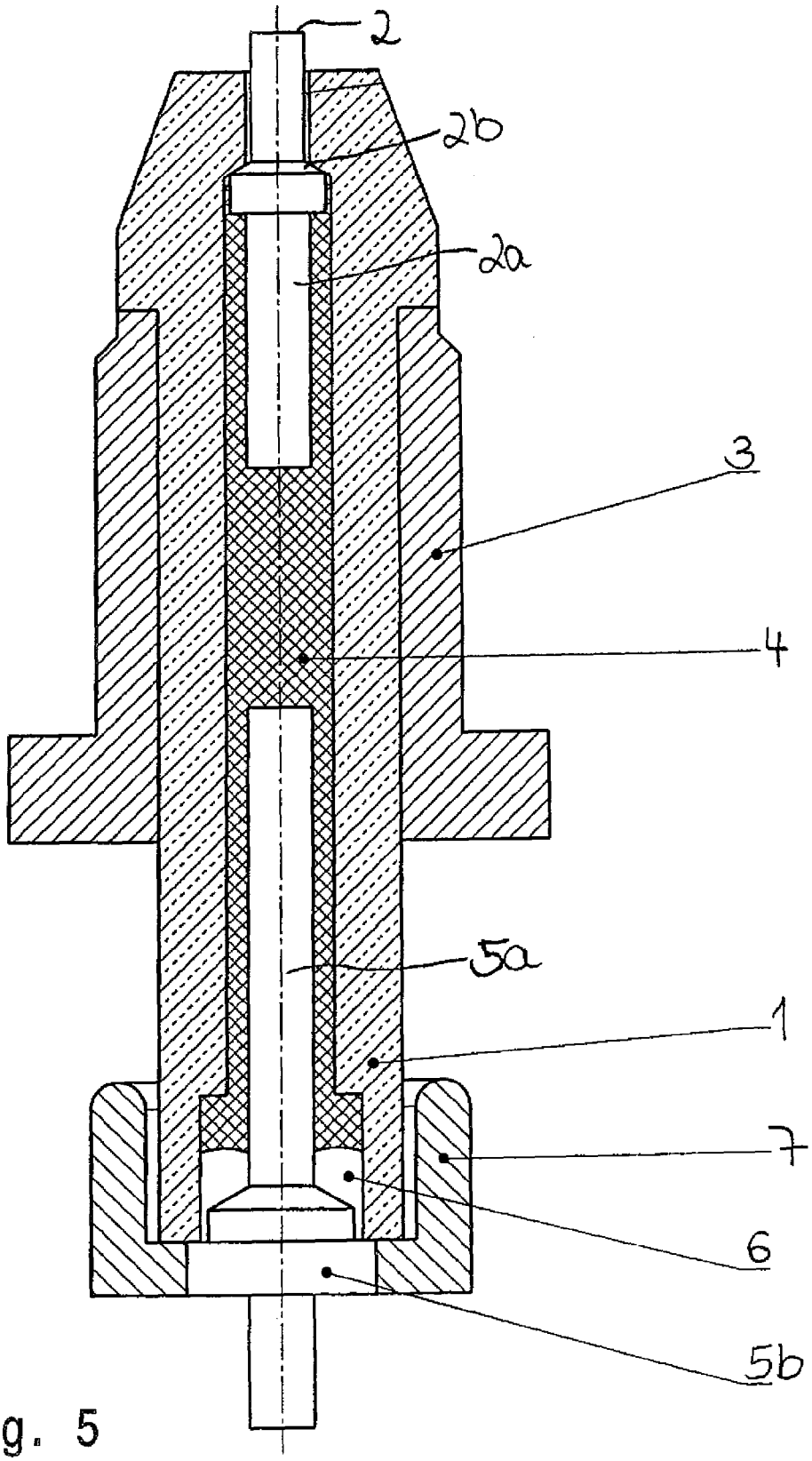
FIG. 5 shows a longitudinal view of a further embodiment.

A further embodiment of an HF ignition device is shown in FIG. 5. In this embodiment, the closure of the channel is formed by a thickened region 2*b* of conductor piece 2*a* inserted into the channel. This thickened region forms a mating surface which rests against a mating surface in the interior of insulating body 1. In the embodiment shown, the mating surface of closure 2*b* is conical and rests against the inner wall of a tapered section of the channel.

REFERENCE NUMERALS

1 Insulating body
2 Ignition electrode
2*a* Conductor piece
2*b* Closure
3 Outer conductor
4 Filling material
5*a* Conductor piece
5*b* Closure
6 Annular space
7 Shield cap

What is claimed is:

1. An HF ignition device for igniting a fuel in an internal combustion engine with a corona discharge, comprising:

an ignition electrode;

an insulating body defined as having a first end and a second end opposite the first end, wherein the ignition electrode is disposed at the first end of the insulating body, the insulating body having a continuous channel in which an inner conductor electrically coupled to the ignition electrode is disposed; and an outer conductor which encloses the insulating body and, in combination with a section of the inner conductor, forms a capacitor, wherein the continuous channel is filled with an electrically conductive filling material which encloses at least one section of the inner conductor, wherein the continuous channel at the second end of the insulating body contains an air-filled annular space.

2. The HF ignition device according to claim 1, the air-filled annular space is directly adjacent to the electrically conductive filling material.

3. The HF ignition device according to claim 1, wherein the air-filled annular space is disposed in a widened end section of the channel.

4. The HF ignition device according to claim 1, wherein the air-filled annular space is enclosed by a shield cap.

5. The HF ignition device according to claim 1, wherein the filling material adheres to an electrically conductive closure of the channel.

6. The HF ignition device according to claim 5, wherein the closure comprises a mating surface which forms an angle with the longitudinal direction of the channel.

7. The HF ignition device according to claim 5, wherein the closure is a section of the conductor extending into the channel.

8. The HF ignition device according to claim 1, wherein the at least one section of the inner conductor is a pin extending outwardly from the ignition electrode.

9. The HF ignition device according to claim 1, wherein the filling material is a longitudinal section of the inner conductor.

10. The HF ignition device according to claim 1, wherein a further section of the inner conductor is formed by a second conductor piece inserted into the channel at the first end.

11. An HF ignition device for igniting a fuel in an internal combustion engine with a corona discharge, comprising:

an ignition electrode;

an insulating body defined as having a first end opposite a second end, wherein the ignition electrode is disposed at the first end of the insulating body, the insulating body having a continuous channel in which an inner conductor electrically coupled to the ignition electrode is disposed;

an outer conductor which encloses the insulating body and, in combination with a section of the inner conductor, forms a capacitor, wherein the continuous channel is filled with an electrically conductive filling material which encloses at least one section of the inner conductor; and an electromagnetic shield cap attached at the second end of the insulating body.

12. A high frequency ignition device configured for igniting a fuel in an internal combustion engine with a corona discharge, comprising:

an insulating body comprising a chamber disposed through from a first end to a second end;

an ignition electrode disposed at the first end of the insulating body;

an inner conductor located in the chamber, wherein an inner conductor thickness is less than a chamber thickness, wherein the inner conductor is electrically coupled to the ignition electrode and configured to be electrically connectable to a high frequency alternating voltage;

an outer conductor enclosing the insulative body;

an electrically conductive filling disposed within the chamber between the insulative body and the inner conductor; and wherein the outer conductor, insulating body and the inner conductor with the electrically conductive filling comprises a capacitor, where the insulating body along a capacitive portion of the capacitor comprises a uniform cross-sectional area.

* * * * *